US005292126A

United States Patent [19]

Hanley

[11] Patent Number: 5,292,126

[45] Date of Patent: Mar. 8, 1994

[54] GAME EMPLOYING ROTATING DISKS

[76] Inventor: James Hanley, 28 Farmingdale, Parsippany, N.J. 07054

[21] Appl. No.: 991,399

[22] Filed: Dec. 16, 1992

[51] Int. Cl.[5] ..... A63F 9/06; A63B 67/14

[52] U.S. Cl. ..... 273/153 S; 273/113

[58] Field of Search ..... 273/155, 153 S, 153 R, 273/110, 113, 115, 118 R, 123 R

[56] References Cited

U.S. PATENT DOCUMENTS

| | | | |
|---|---|---|---|
| 558,066 | 4/1896 | Happersett . | |
| 600,696 | 3/1898 | Patterson . | |
| 679,782 | 8/1901 | Reenstierna . | |
| 2,440,949 | 5/1948 | Herrman | 273/113 |
| 3,610,628 | 10/1971 | Promin | 273/138 |
| 3,747,937 | 7/1973 | Fabricani | 273/153 |
| 3,895,808 | 7/1975 | Averette | 273/138 |
| 4,008,895 | 2/1977 | Reiner et al. | 273/113 |
| 4,376,537 | 4/1983 | Yokoi | 273/153 |
| 4,413,823 | 11/1983 | Breslow | 273/153 |
| 4,509,753 | 4/1985 | Vaughan, Jr. | 273/110 |
| 4,545,577 | 10/1985 | Randleman | 273/113 |
| 4,754,972 | 7/1988 | Boskovic | 273/113 |
| 4,822,049 | 4/1989 | Biber | 273/110 |
| 4,872,673 | 10/1989 | Hanley . | |
| 5,123,650 | 6/1992 | Slauter | 273/155 |

FOREIGN PATENT DOCUMENTS

| | | | |
|---|---|---|---|
| 1199351 | 11/1983 | Canada . | |
| 1437056 | 11/1988 | United Kingdom . | |
| 1466771 | 3/1989 | United Kingdom . | |
| 2211099 | 6/1989 | United Kingdom | 273/109 |

*Primary Examiner*—Vincent Millin
*Assistant Examiner*—Steven B. Wong
*Attorney, Agent, or Firm*—Thomas L. Adams

[57] ABSTRACT

A game has a plurality of playing pieces and a plurality of stacked disks. Each of the disks is pierced by an angularly spaced plurality of peripheral apertures. At least one of the apertures in each of the disks is sized to allow passage of the playing pieces. An entrapping one of the apertures in each of the disks is shaped to prevent passage of the playing pieces. These disks are interconnected to rotate relatively and coaxially. Each of the disks has its apertures alignable of those of adjacent ones of the disks. The game includes a pair of cups separately mounted on opposite, outermost ones of the stacked disks to turn therewith and to contain the playing pieces.

11 Claims, 1 Drawing Sheet

GAME EMPLOYING ROTATING DISKS

BACKGROUND OF THE INVENTION

The present invention relates to games, and in particular, to games employing rotating disks through which a playing piece can be moved.

The game in U.S. Pat. No. 4,509,753 has several rotating layers which when stacked have the shape of a pyramid. Each layer has several holes and all but one are blind holes. A ball can be dropped in a hole in an upper layer. That layer is positioned so the ball drops into a hole in the next layer. If that next hole is blind the ball becomes trapped. A disadvantage with this game is the lack of cups or equivalent structure to contain balls. Thus only one ball can be in play at a time. Another disadvantage with this known structure is that the pyramid is made of wood and is therefore opaque. Thus the player is operating without visual cues, which makes the game less interesting. Also because the holes are blind, the structure must employ slanted bores to prevent a player from sighting through the pyramid to determine if the passage ends in a blind hole. Furthermore, this known game has a limited number of holes and therefore the options are rather limited.

The known puzzle of U.S. Pat. No. 3,610,628 has a column with internal disks, each having a straight ball hole. The disks are rotated until a ball above a disk falls into the hole. This reference however does not have a feature whereby the balls can be trapped in the holes.

In U.S. Pat. No. 4,754,972 rotatable disks provide a complex maze in which balls not only pass through rotating disks but can reverse direction inside the disks as well. This type of arrangement, however, does not have the simplicity aligning simple bores. See also U.S. Pat. Nos. 558,066; 600,696; 679,782; 3,747,937; 3,895,808; 4,008,895; 4,376,537; 4,413,823; 4,545,577; and 4,822,049; Canadian Patent 1,199,351; and Soviet references 1,437,056; and 1,466,771.

SUMMARY OF THE INVENTION

In accordance with the illustrative embodiments demonstrating features and advantages of the present invention, there is provided a game having a plurality of playing pieces. The game has a plurality of stacked disks, each pierced by an angularly spaced plurality of peripheral apertures. At least one of these apertures in each of the disks is sized to allow passage of the playing pieces. An entrapping one of the apertures in each of the disks is shaped to prevent passage of the playing pieces. The disks are interconnected to rotate relatively and coaxially. Each of the disks has its apertures alignable with those of adjacent ones of the disks. The game includes a pair of cups separately mounted on opposite, outermost ones of the stacked disks to turn therewith and to contain the playing pieces.

By employing structure of the foregoing type, an interesting and unique game is achieved. In the preferred embodiment, four flat cylindrical disks have eight, peripheral, equiangularly spaced holes. These disks are stacked coaxially and each has a concentric hole fitted with a spindle to allow the four disks to rotate relative to each other. The end disks have a cup mounted around them.

Preferably, a number of balls initially contained inside the cups can travel through the disks. To permit ball passage, the disks must be rotated to align the apertures having clearance to allow this ball passage.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention, when taken in conjunction with the accompanying drawings, wherein.

DETAILED DESCRIPTION OF THE PREFERRED EMBODIMENTS

Figure 1:
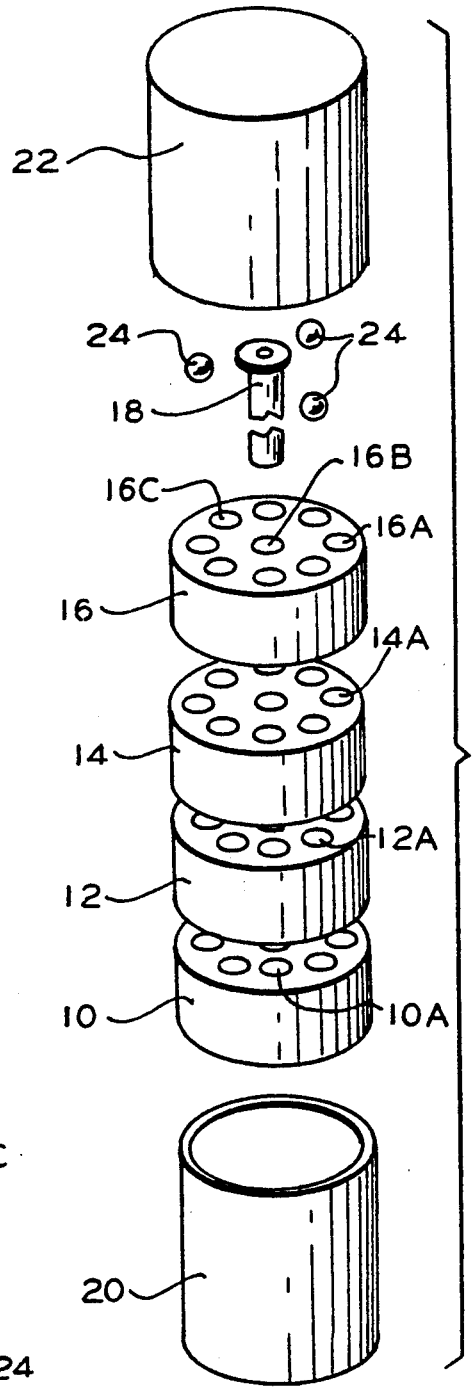
FIG. 1 is an exploded, axonometric view of a game in accordance with the principles of the present invention.
Figure 2:
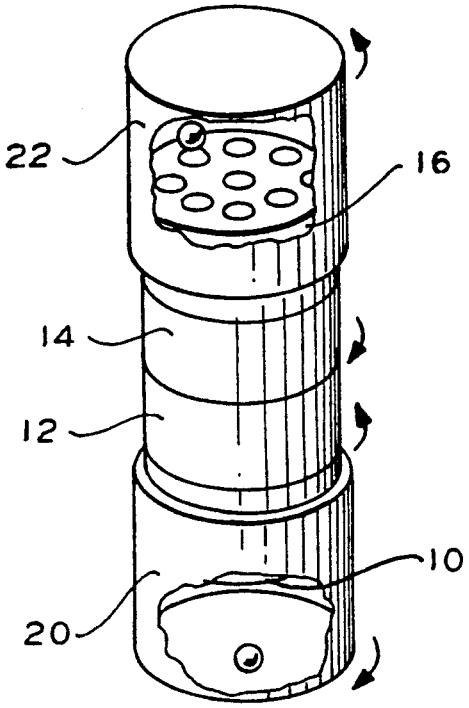
FIG. 2 is an assembled, axonometric view of the game of FIG. 1.

Referring to FIGS. 1, and 2, a game is shown employing four disks 10, 12, 14 and 16. Each of the disks 10, 12, 14 and 16 have eight equiangularly spaced peripheral apertures 10A, 12A, 14A and 16A, respectively. Each of the apertures 10A–16A are shown spaced 45° apart. In other embodiments, however, the number of apertures and their angular spacing can be varied. In one constructed embodiment, disks 10–16 were each 1¼ inch in diameter, although this dimension can be varied and need not be uniform from disk to disk. Also in that embodiment, apertures 10A–16A were 7/32 inch in diameter, but that dimension can be varied depending upon the desired size, visual detail, etc. Disks 10–16 are preferably molded from transparent plastic such as Lexan, although other materials can be used, which may also be machined instead of molded.

A concentric hole exists in each of the disks 10–16. Concentric holes 14B and 16B are illustrated herein for disks 14 and 16, and disks 10 and 12 have a similar concentric hole. The concentric holes can be, for example, ¼ inch in diameter. In this embodiment disks 10–16 are identical, although in other embodiments variations from disk to disk are possible.

The illustrated tubular spindle 18 is mounted through the concentric holes (holes 14B, 16B, etc.) in disks 10–16. Spindle 18 may be installed initially as a simple, tubular, thermoplastic rod that is inserted through the concentric holes of disks 10–16. Its ends are flared by pressing a heated appliance against the ends of spindle 18.

A pair of transparent cups 20 and 22 are glued around the circumference of disks 10 and 16, respectively. Cups 22 have a generally cylindrical shape although in other embodiments, they may be spherical, prismatic or other shape. Also, the cups may be attached to the flat face rather than the periphery of the disks.

A number of playing pieces, shown as steel balls 24, are located inside cup 20 and 22, or as explained hereinafter, in the apertures of disks 10–16.

Figure 3:
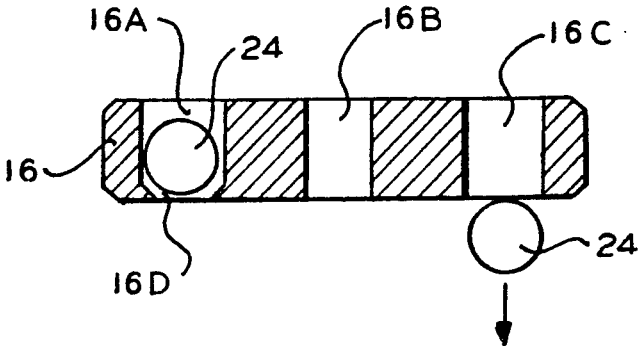
FIG. 3 is a cross-sectional view of one of the disks of FIG. 1.

Referring to FIG. 3, previously illustrated disk 16 is shown in cross-section with its outside corners bevelled. A typical aperture 16A is shown having an entrapping shape, in this instance, a cylindrical bore converging on an annular lip 16D. Lip 16D prevents ball 24 from passing through aperture 16. In contrast, aperture 16A' does not have a lip and its diameter is sized to allow ball 24 to pass through disk 16.

Disk 16 (as well as the other disks) has a lip 16D in each of the apertures except for aperture 16A'. As mentioned earlier, each of the disks are identical so that each has only one aperture through which the ball 24 can pass. In other embodiments more than one aperture may allow ball passage and the number and location of ball-passing apertures may vary from disk to disk.

To facilitate an understanding of the principles associated with the foregoing apparatus, its operation will now be briefly described. The assembled game, as shown in FIG. 2 may be played with the three balls 24 initially located inside cup 22 above disk 16. The three balls may be guided into various apertures 16A in disk 16 by tilting or shaking the game. If one of the holes does not have a restraining lip 16D (FIG. 3) the ball may fall through disk 16 to the next disk 14, when the apertures are aligned. With fortuitous alignment, a ball could fall through all four disks at once and reach cup 20.

However, balls 24 can drop into apertures in disk 16 having restraining lip 16D. Lip 16D is relatively small so that a player cannot visually distinguish one hole from the other. Thus, the player does not know until ball 24 enters an aperture 16A whether that aperture has a restraining lip or not.

Since most apertures have restraining lips, balls typically will be trapped within one of the apertures of disk 16. Entrapment is detected by rotating the disks to see if ball 24 will clear disk 16 and drop into disk 14. If the aperture 16A containing a ball 24 does not have a restraining lip 16D (FIG. 3) that ball can fall to the next disk 14. Thereafter, disk 14 can itself be rotated to see if its ball will drop to the next disk, disk 12. If a ball in disk 16 is trapped it can be placed in another aperture by tilting or inverting the game.

Any ball reaching disk 14 may be unable to descend further and may be trapped in an aperture having a restraining lip (such as lip 16D in FIG. 3). The ball 24 must be removed from an entrapping aperture by reversing direction. To this end, the game can be tilted or inverted to return ball 24 to disk 16, in the aperture 16A' having ball clearance. Disks 14 and 16 may then be relatively rotated to bring ball 24 into a different aperture in disk 14. If the new aperture in disk 14 still has a restraining lip the ball may be moved to another aperture using the process just described. In this way, ball 24 can be moved from aperture to aperture in disk 14 until finally reaching an aperture that does not have a restraining lip. At that time ball 24 will move to disk 12.

This process can be repeated to move ball 24 from disk to disk. Eventually ball 24 will reach an aperture in disk 12 lacking a restraining lip and will drop into cup 20. This ball moving process can be performed serially or in parallel to move all balls to lower cup 20.

Balls 24 can be returned from cup 20 to cup 22 quickly, because balls 24 will not move into a succeeding disk unless that succeeding disk lacks a restraining lip. Therefore, the returning balls will move without becoming trapped while the disks are relatively rotated.

It is to be appreciated that various modifications may be implemented with respect to the above described preferred embodiments. For example, in some embodiments the playing pieces may not be spherical but can be cubical, ovoid, etc. Also, the disks need not have a circular perimeter but may be oval, polygonal or have various other shapes. Also, the degree of transparency and the color of various components can be altered. Additionally, the number and placement of apertures can be altered and in some embodiments the apertures in each disk need not be equal in number nor equiangularly spaced. Also, the number of disks can be greater or fewer than four, depending upon the desired complexity of the game. Moreover, in some embodiments markings or gradations may be placed on the cup or disks to indicate the relative position of the apertures. Furthermore, the number of balls employed can be greater or fewer than the three illustrated.

Obviously, many modifications and variations of the present invention are possible in light of the above teachings. It is therefore to be understood that within the scope of the appended claims, the invention may be practiced otherwise than as specifically described.

I claim:

1. A game comprising:

at least one playing piece;

a plurality of stacked disks each pierced by an angularly spaced plurality of peripheral apertures, at least one of said apertures in each of the disks being sized to allow passage of said playing piece, an entrapping one of said apertures in each of said disks being shaped to prevent passage of said playing piece, said entrapping one of said apertures in each of said disks passing through said disks to open on axially opposite sides thereof, said disks being interconnected to rotate relatively and coaxially, each of said disks having its apertures alignable with those of adjacent ones of said disks; and a pair of cups separately mounted on opposite, outermost ones of said stacked disks to turn therewith and to contain said playing piece.

2. A game according to claim 1 wherein said disks have a transparency allowing observation of the location of said playing piece in said disks.

3. A game according to claim 1 wherein said cups have a transparency allowing observation of the location of said playing piece in said cups.

4. A game according to claim 3 wherein said entrapping one of said apertures comprises a cylindrical bore terminating in an annular lip having a reduced diameter, said lip being visually inconspicuous to prevent identification of said entrapping one.

5. A game according to claim 4 wherein said disks each have a concentric hole, said game comprising a spindle mounted through the concentric hole in said disks.

6. A game according to claim 5 wherein each of said disks are substantially cylindrical, said apertures in each of the disks being equiangularly spaced and equal in number.

7. A game according to claim 1 wherein said cups have an inside diameter exceeding the outside diameter of said disks.

8. A game according to claim 1 wherein said playing piece comprises a plurality of identically sized spheres.

9. A game according to claim 8 wherein each of said disks has an identical shape.

10. A game according to claim 9 wherein each of said cups has an identical shape.

11. A game comprising:

a plurality of identically sized, spherical playing pieces;

a plurality of substantially cylindrical, identically shaped, stacked disks each pierced by an equiangularly spaced plurality of peripheral apertures, said apertures in each of the disks being equal in number, at least one of said apertures in each of the disks being sized to allow passage of said playing pieces, an entrapping one of said apertures in each of said disks being shaped to prevent passage of said playing pieces, said entrapping one of said apertures including a cylindrical bore terminating in an annular lip having a reduced diameter, said lip being visually inconspicuous to prevent identification of said entrapping one said apertures, said disks being interconnected to rotate mutually and coaxially, each of said disks having its apertures alignable with those of adjacent ones of said disks, said disks having a transparency allowing observation of the location of said playing pieces in said disks, said disks each having a concentric hole;

a spindle mounted through the concentric hole in each of said disks; and a pair of identically shaped cups separately mounted on opposite, outermost ones of said stacked disks to turn therewith and to contain said playing pieces, said cups having a transparency allowing observation of the location of said playing pieces in said cups, said cups having an inside diameter exceeding the outside diameter of said disks.

* * * * *